US006927739B2

(12) United States Patent
Nomura et al.

(10) Patent No.: US 6,927,739 B2
(45) Date of Patent: Aug. 9, 2005

(54) ANTENNA AND WRISTWATCH EQUIPPED WITH ANTENNA

(75) Inventors: Keiichi Nomura, Fussa (JP); Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 10 days.

(21) Appl. No.: 10/761,480

(22) Filed: Jan. 20, 2004

(65) Prior Publication Data

US 2004/0150578 A1 Aug. 5, 2004

(30) Foreign Application Priority Data

Jan. 28, 2003 (JP) ..... 2003-018590

(51) Int. Cl.[7] ..... H01Q 7/08
(52) U.S. Cl. ..... 343/788; 343/718; 235/487
(58) Field of Search ..... 343/718, 720, 343/728, 742, 744, 787, 788, 866, 867; 368/10; 235/487

(56) References Cited

U.S. PATENT DOCUMENTS 4,873,527 A * 10/1989 Tan ..... 343/718
5,627,552 A * 5/1997 Farrar et al. ..... 343/718
6,853,605 B2 * 2/2005 Fujisawa et al. ..... 368/10

FOREIGN PATENT DOCUMENTS

JP 55-091237 A 7/1980

* cited by examiner

*Primary Examiner*—Tuyet Vo
*Assistant Examiner*—Jimmy Vu
(74) *Attorney, Agent, or Firm*—Frishauf, Holtz, Goodman & Chick, P.C.

(57) ABSTRACT

The antenna main body having the conductor wound around thereon and the radio wave receiving parts for receiving the radio waves are formed independently, the area of the radio wave receiving region of the radio wave receiving parts is formed to be larger than a cross sectional area of the antenna main body in the direction orthogonal to the winding direction of the conductor, and the radio wave receiving parts are arranged so as to be in contact with the antenna main body at the ends in the winding direction of the conductor.

11 Claims, 11 Drawing Sheets

ANTENNA AND WRISTWATCH EQUIPPED WITH ANTENNA

CROSS-REFERENCE TO RELATED APPLICATIONS

This application is based upon and claims the benefit of priority from the prior Japanese Patent Application No. 2003-18590, filed Jan. 28, 2003, and the entire contents of which are incorporated herein by reference.

BACKGROUND OF THE INVENTION

1. Field of the Invention

The present invention relates to an antenna and a wristwatch equipped with the antenna.

2. Description of the Prior Art

There has been known a radio wave watch as a watch that displays the time accurately. The radio wave watch receives time information transmitted on radio waves for correcting the time, and displays the corrected accurate time. This watch has a built-in antenna for receiving the time informative radio waves. As shown in FIG. 13, an earlier developed antenna 70 is constructed by winding a conductor 72 as a coil around a bar-type magnetic body 71 formed of ferrite. The receiving sensitivity of such antenna 70 is determined by the size of a wave receiving area, that is, by the area at both ends of the magnetic body 71. Therefore, in order to improve the wave receiving sensitivity of the antenna 70, it has been proposed to enlarge both ends of a magnetic body 81 of an antenna 80, as shown in FIG. 14, to expand the wave receiving area.

However, several problems arise in using the ferrite-made magnetic body 81. Its mechanical fragility causes difficulty of manufacturing as the radio wave receiving areas at both ends of the magnetic body 81 are expanded, and also causes limitation of expanding the radio wave receiving area due to its low strength.

SUMMERY OF THE INVENTION

An object of the invention is to provide an antenna and a watch equipped with this antenna which permit easier manufacturing even if a magnetic body has a larger radio wave receiving area.

In order to solve the problems mentioned above, in the present invention, an antenna main body having a conductor as a coil wound around a magnetic body and a radio wave receiving part for receiving a radio wave are formed independently, an area of the radio wave receiving region of the radio wave receiving part is formed larger than a cross section of the antenna main body in a direction orthogonal to an axis line of the antenna main body, and the radio wave receiving part is arranged so as to be in contact with the antenna main body at an end in an axis line direction of the antenna main body.

DETAILED DESCRIPTION OF THE PREFERRED EMBODIMENTS

A detailed description will now be given of an antenna and a wristwatch equipped with the antenna according to the invention.

[First Embodiment]

Figure 1:
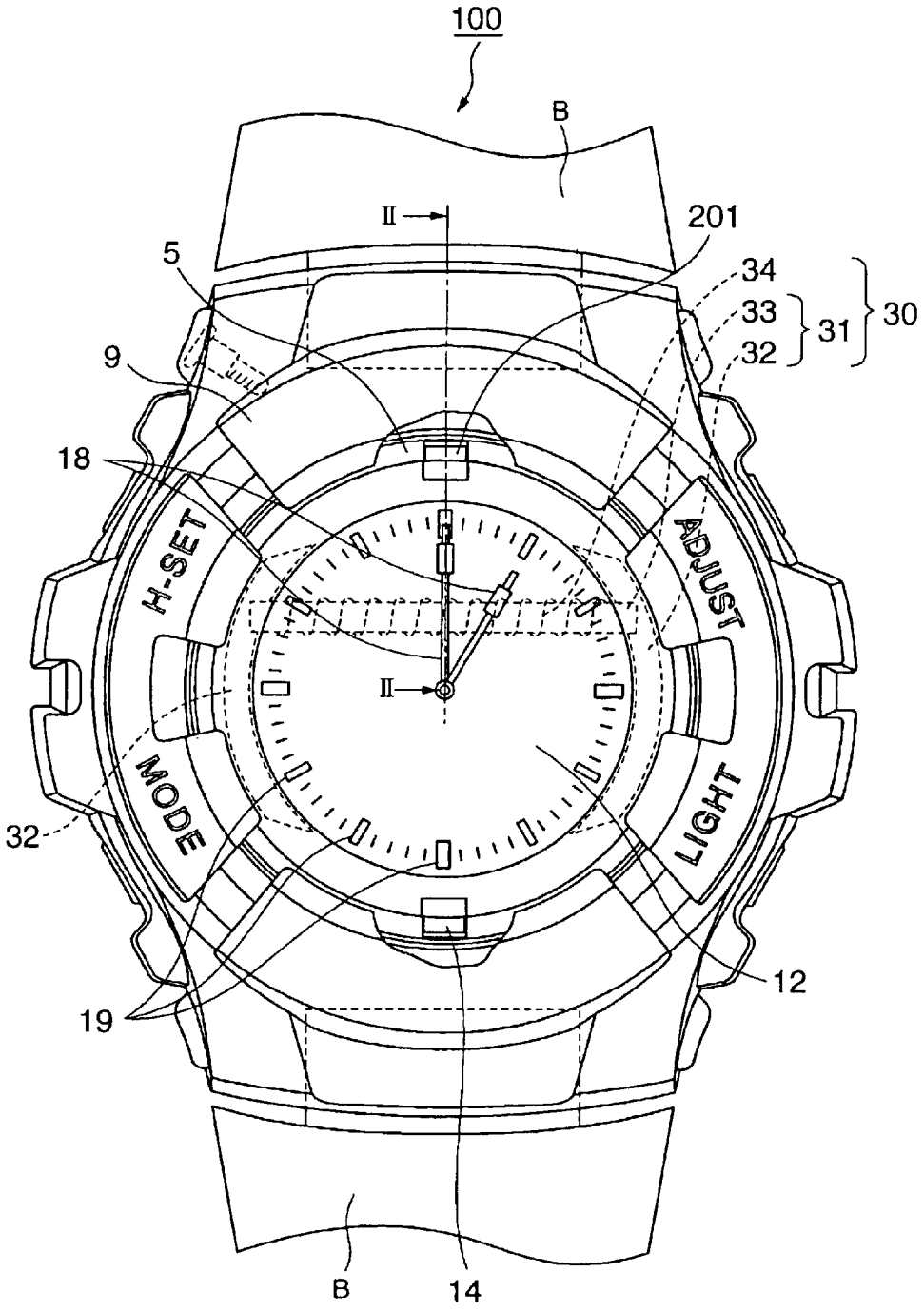
FIG. 1 is a schematic plan view of a wristwatch according to a first embodiment of the present invention.
Figure 2:
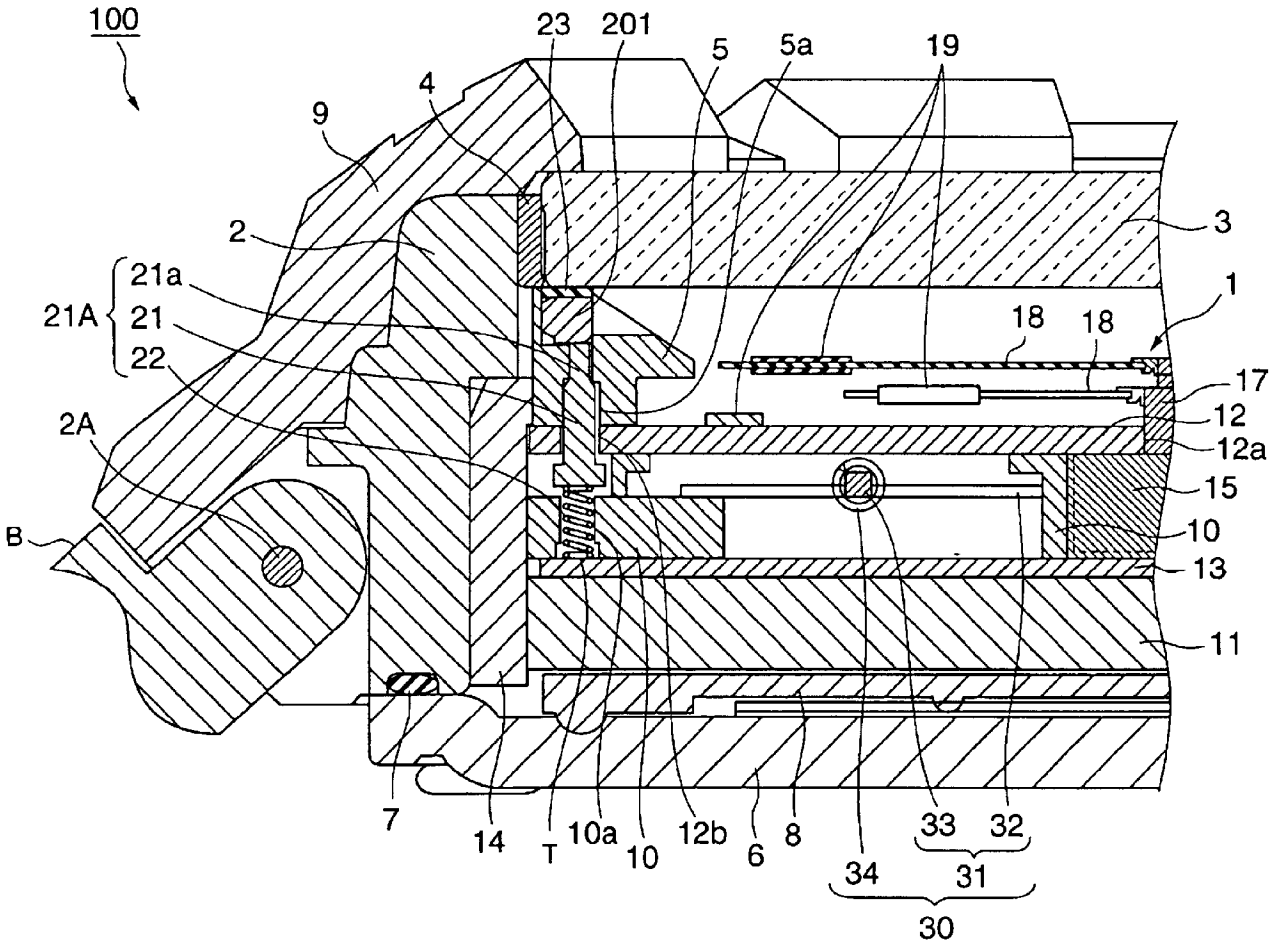
FIG. 2 is a cross-sectional view taken along the line II—II of FIG. 1.

As shown in FIGS. 1 and 2, an antenna 30 is built in a wristwatch 100, and receives time information on radio waves to correct the indicated time of the wristwatch 100.

The wristwatch 100 has a watch case 2 as a case body for containing a watch module 1 at the inside. The watch case 2 has a watch glass 3 mounted at the upper center via a packing 4. The watch module 1 has a frame member 5 which is arranged so as to contact with the watch glass 3 at the upper side. At the bottom of the case 2, there is attached a case back 6 via a waterproof seal 7, and a shock absorber 8 is provided between the module 1 and the case back 6. There is also provided a bezel 9 at the upper outer periphery of the case 2. Additionally, a watch band B is attached to the case 2 via band shafts 2A.

The watch module 1 has an analog function. As shown in FIG. 2, the module 1 has an upper housing 10 and a lower housing 11 as intermediate members. A dial 12 is arranged at the upper surface of the upper housing 10, and the frame member 5 is disposed above the dial 12. Under the frame member 5, there is disposed a circuit board 13 as an electronic board interposed between the upper housing 10 and the lower housing 11 by a predetermined space. The module 1 is so constructed that the dial 12, upper housing 10, circuit board 13 and lower housing 11 are mounted on an inner frame 14 of the watch case 2.

The upper housing 10 is provided with an analog hand mechanism 15, and a battery (not shown) is embedded in the lower housing 11 for driving, for example, the hand mechanism 15 or the like.

The upper housing 10 further includes an antenna 30.

Figure 3A:
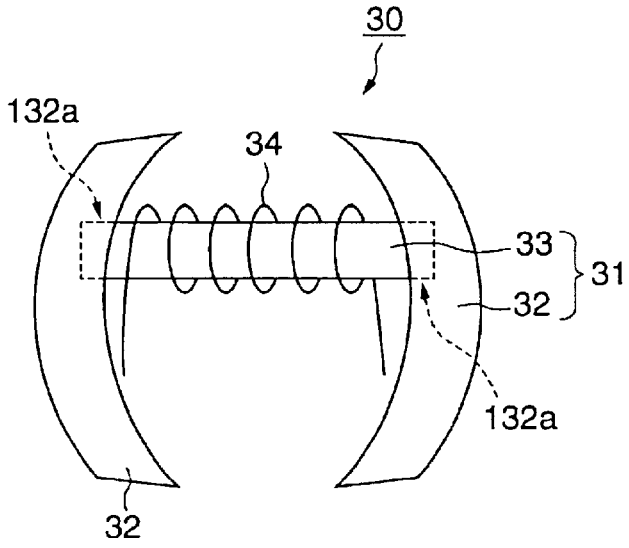
FIG. 3A is a schematic plan view of an antenna according to the first embodiment of the invention.
Figure 3B:
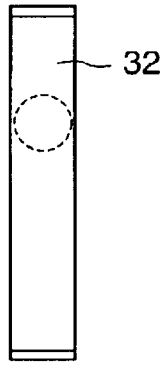
FIG. 3B is a schematic side view of a radio wave receiving part of an antenna according to the first embodiment of the invention.

The antenna 30 has, as shown in FIGS. 3A and 3B, a magnetic body 31 that is magnetized by radio waves, a conductor 34 wound around a part of the magnetic body 31 so that current flows through the conductor 34 according to the intensity of magnetic field induced in the magnetic body 31 and the like.

The magnetic body 31 has radio wave receiving parts 32 for receiving time informative radio waves, and an antenna main body 33 which is formed independently of the radio wave receiving parts 32 and has the conductor 34 wound around on its surface.

The radio wave receiving part 32, which is formed of ferrite or the like and curved in a belt along the upper housing 10, is disposed on the upper housing 10. Each radio wave receiving part 32 has a concavity 132*a* formed thereon for coupling to the antenna main body 33. The radio wave receiving parts 32 are positioned opposing to each other with the antenna main body 33 placed between them, for example, at the three o'clock and the nine o'clock sides. The radio wave receiving parts 32 are coupled to the main body 33 by fitting both ends of the antenna main body 33 into the opposing respective concavities 132*a*. That is, the antenna main body 33 is removably coupled to the receiving parts 32.

The antenna main body 33 is provided so as to couple to the concavities 132*a*, and its both ends are supported on the upper housing 10 on which the wave receiving parts 32 are disposed.

The antenna main body 33 has the conductor 34, such as a copper wire or the like, wound around on it. Radio waves magnetize the antenna main body 33 so that current flows in the conductor 34 depending on the intensity of the magnetic field produced in the magnetized antenna main body 33.

The analog hand mechanism 15 includes a hand shaft 17 extending upward through a shaft hole 12*a* provided on the dial 12, and hands 18, such as an hour hand and a minute hand, mounted on the hand shaft 17, the hands 18 traveling above the dial 12. The dial 12 and the hands 18 have respective illuminating sections 19 at their predetermined positions, the illuminating sections 19 being illuminated by receiving the light from light emitting elements.

The frame member 5 is formed of, for example, light-transmissible synthetic resin, particularly of transparent synthetic resin. As shown in FIG. 2, the frame member 5 is mounted on the inner surface of the watch case 2, touching the circumference of the lower surface of the watch glass 3 and the circumference of the upper surface of the dial 12 (the upper housing 10). At predetermined positions on the frame member 5, for example, at the positions corresponding to the twelve o'clock and the six o'clock as shown in FIG. 1, there are arranged ultraviolet (UV) light emitting elements 201 called black light. The frame member 5 arranged with the UV light emitting elements 201 also acts as a protection member or a shock absorbing member. The UV light emitting element 201 is a UV lamp or UV light emitting diode (LED) or the like, which emits an ultraviolet ray having a wavelength of, for example, 254–420 nm (nanometer) or 374–389 nm, preferably about 365 nm.

Referring back to FIG. 2, the UV light emitting element 201 is supported by a connecting member 21A, and is fixed. The connecting member 21A includes a contact member 21 touching the UV light emitting element 201, and a coil spring 22 acting as an urging member for urging the contact member 21. The contact member 21 has a pair of support shafts 21*a* (one side only is shown in FIG. 2) corresponding to the electrodes (not shown) of the UV light emitting element 201, the shafts 21*a* being in contact with the respective electrodes.

The contact member 21 having conductivity is, at its center portion, inserted into a through hole 10*a* provided on the upper housing 10, as well as a through hole 12*b* on the dial 12 and a through hole 5*a* on the frame member 5, and projected upward at the upper end portion of the frame member 5. This projected upper end (the pair of support shafts 21*a*) abuts against the UV light emitting element 201. There is provided a cushion 23 between the element 201 and the watch glass 3.

The coil spring 22 having conductivity is inserted into the through-hole 10*a*, and elastically pushed against a connecting terminal T formed on the circuit board 13 at the lower end and against the lower end of the contact member 21 at the upper end. With this structure, the spring 22 urges the contact member 21 toward the UV light emitting element 201 to elastically support it. Further, the connecting member 21A including the contact member 21 and the spring 22 electrically connects the UV light emitting element 201 with the circuit board 13.

The illuminating sections 19 are formed as resin parts, printed parts or painted parts at the predetermined positions on the dial 12 such as the upper surfaces of mark portions or hour numerals, and at the predetermined positions on the hands 18 in the analogue hand mechanism 15. It is preferable that the upper surfaces of the illuminating sections 19 are covered with transparent coating substance (not shown) for protection.

These illuminating sections 19 emit colored light, responding to the ultraviolet rays having the wave length of, for example, 350–420 nm or 254–365 nm, and remain transparent in normal state if not irradiated with ultraviolet rays. That is, the illuminating sections 19 emit colored light responding to the ultraviolet rays emitted from the UV emitting element 201 or to the ultraviolet rays passed through the light transmissible frame member 5.

According to the antenna 30 in the embodiment, the antenna main body 33 and the radio wave receiving parts 32 are formed independently, so that both of the antenna main body 33 and the radio wave receiving part 32 can be formed in simple shapes, whereby manufacturing of the entire magnetic body becomes easier even if the area of the radio wave receiving region of the radio wave receiving part 32 is expanded. Additionally, since partially loaded positions do not exist, the mechanical strength of the antenna 30 is improved. In other words, the area of the radio wave receiving region of the radio wave receiving part 32 can be formed larger than the cross sectional area of the main body 33 in a direction orthogonal to an axis line of the antenna body 33 (a winding direction of the conductor 34 wound around the antenna main body 33), so that radio wave receiving sensitivity can be improved, and directivity can be moderated due to the increase of receivable directions.

Next, a description will be given of modifications of the antenna 30 in the first embodiment described above.

<Modification 1>

Figure 4A:
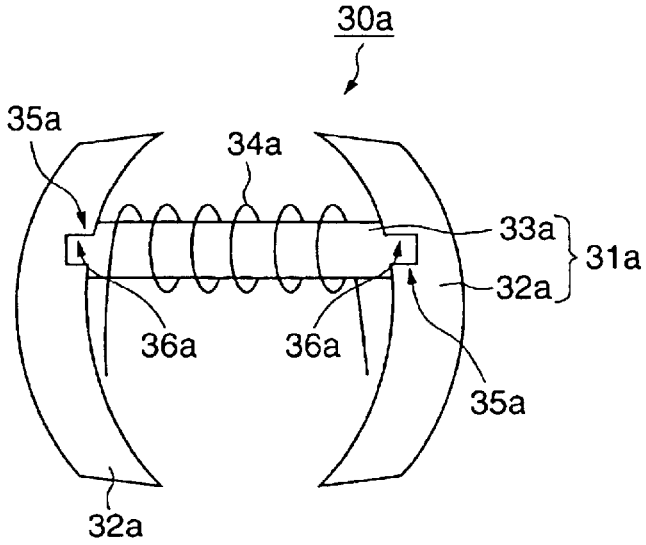
FIG. 4A is a schematic plan view of an antenna according to modification 1 of the first embodiment of the invention.
Figure 4B:
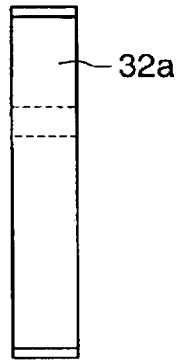
FIG. 4B is a schematic side view of a radio wave receiving part of an antenna according to modification 1 of the first embodiment of the invention.

Referring to FIGS. 4A and 4B, in an antenna 30*a* according to modification 1, a radio wave receiving part 32*a* has a groove portion 35*a* formed thereon, and an antenna main body 33*a* has protrusions 36*a* at its both ends to fit into the respective groove portions 35*a*. The groove portion 35*a* is formed such that, when the radio wave receiving part 32*a* is placed on the upper housing 10, the groove 35*a* extends from the upper side of the wristwatch 100 to the lower side so that the protrusions 36*a* of the antenna main body 33*a* can fit into the grooves 35*a* to construct the antenna 30*a*. The antenna main body 33*a* includes a conductor 34*a* wound around like a coil on its surface.

With this structure, the antenna main body 33*a* can be attached to the radio wave receiving part 32*a* after the radio wave receiving part 32*a* is mounted on the upper housing 10, which increases flexibility in manufacturing. Further, the main body 33*a* can be pulled out along the groove 35*a* when it is removed, leading to easier removing operation.

<Modification 2>

Figure 5A:
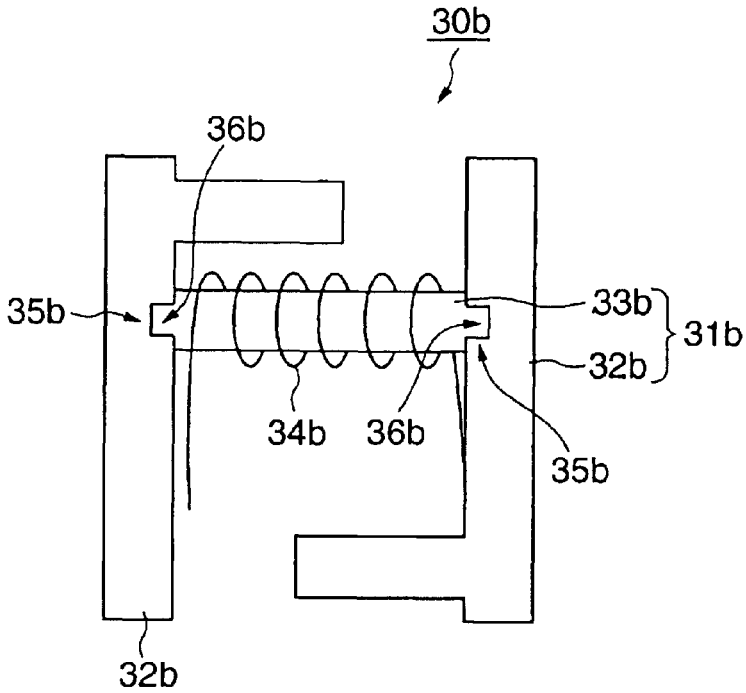
FIG. 5A is a schematic plan view of an antenna according to modification 2 of the first embodiment of the invention.
Figure 5B:
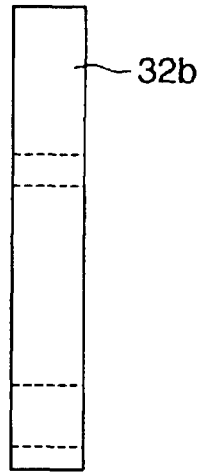
FIG. 5B is a schematic side view of a radio wave receiving part of an antenna according to modification 2 of the first embodiment of the invention.

Referring to FIGS. 5A and 5B, an antenna 30*b* in accordance with modification 2 differs from the modification 1 in that a radio wave receiving part 32*b* is changed to near L-shaped one instead of the arc-shaped radio wave receiving part 32*a*.

Two radio wave receiving parts 32*b* are arranged symmetrical about the center position on the upper surface of the wristwatch 100, each part having a groove portion 35*b* formed thereon, and an antenna main body 33*b* has protrusions 36*b* at its both ends to fit into the respective groove portions 35*b*. The groove 35*b* is formed such that, when the radio wave receiving part 32*b* is placed on the upper housing 10, the groove 35*b* extends from the upper side of the wristwatch 100 to the lower side so that the protrusions 36*b* of the main body 33*b* can fit into the grooves 35*b* to construct the antenna 30*b*. The antenna main body 33*b* includes a conductor 34*b* wound around like a coil on its surface.

Such a structure achieves the same effect as those in the modification 1, and further, two radio wave receiving parts 32*b* form a near rectangular periphery. Therefore, the antenna 30*b* is applicable to a rectangular watch.

<Modification 3>

Figure 6A:
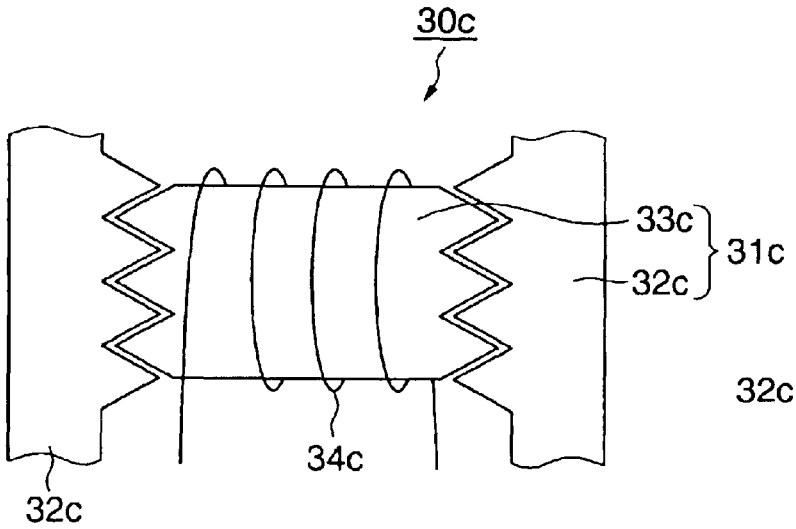
FIG. 6A is a schematic plan view of an antenna according to modification 3 of the first embodiment of the invention.
Figure 6B:
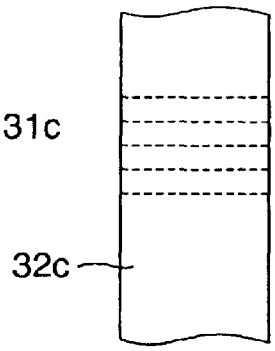
FIG. 6B is a schematic side view of a radio wave receiving part of an antenna according to modification 3 of the first embodiment of the invention.

Referring to FIGS. 6A and 6B, in an antenna 30*c* according to modification 3, both ends of an antenna main body 33*c* are formed in saw-toothed shape having continuous ridge portions and valley portions, and so are the connection parts of radio wave receiving parts 32*c*, the ridge portions and valley portions of the antenna body 33*c* and the radio wave receiving parts 32*c* engaging with each other.

With this structure, the contact surface between the radio wave receiving part 32*c* and the antenna main body 33*c* is larger than that in the modification 1 or modification 2, so that the friction of the connecting position resultantly increases. This friction increase keeps the antenna 30*c* more stable, and stabilizes the sensitivity of receiving radio waves.

<Modification 4>

Figure 7A:
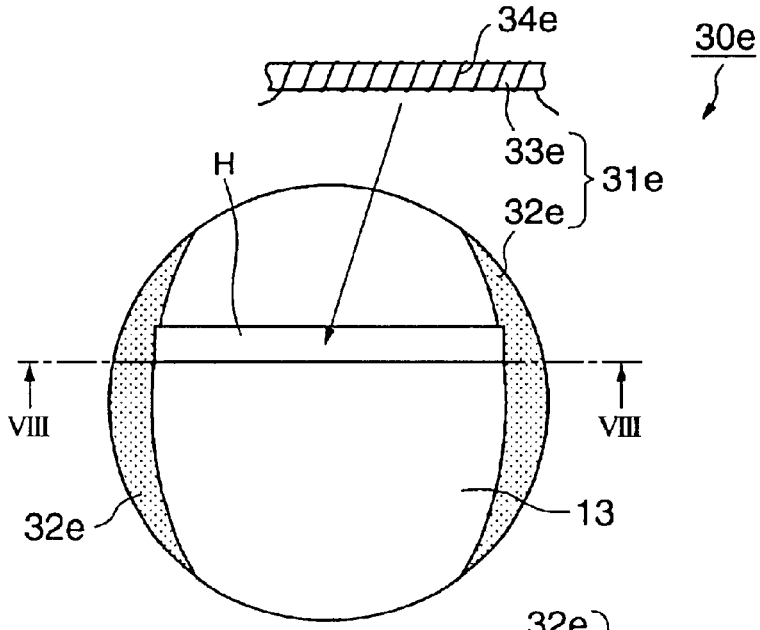
FIG. 7A is a schematic view of an antenna according to modification 4 of the first embodiment of the invention.
Figure 7B:
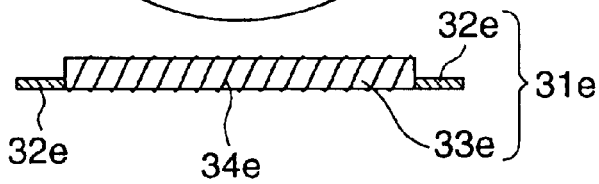
FIG. 7B is a cross-sectional view taken along the line VIII—VIII of FIG. 7A.

Referring to FIGS. 7A and 7B, in an antenna 30*e* according to modification 4, the arc-shaped radio wave receiving parts 32 of the first embodiment are formed on the circuit board 13 as a pattern, and the antenna main body 33 is removably attached to the circuit board 13.

Radio wave receiving parts 32*e* are formed as a pattern at two positions on the circuit board 13 with copper foil or the like, and a mounting hole H is formed between the receiving parts 32*e* for attaching an antenna main body 33*e* thereto. The main body 33*e* is fit into the mounting hole H to construct the antenna 30*e*.

Such a structure makes the thickness of the antenna 30*e* thinner than the main body 33*e* by that of the circuit board 13. Application of this thinner antenna 30*e* can make the wristwatch 100 thinner.

<Modification 5>

Figure 8A:
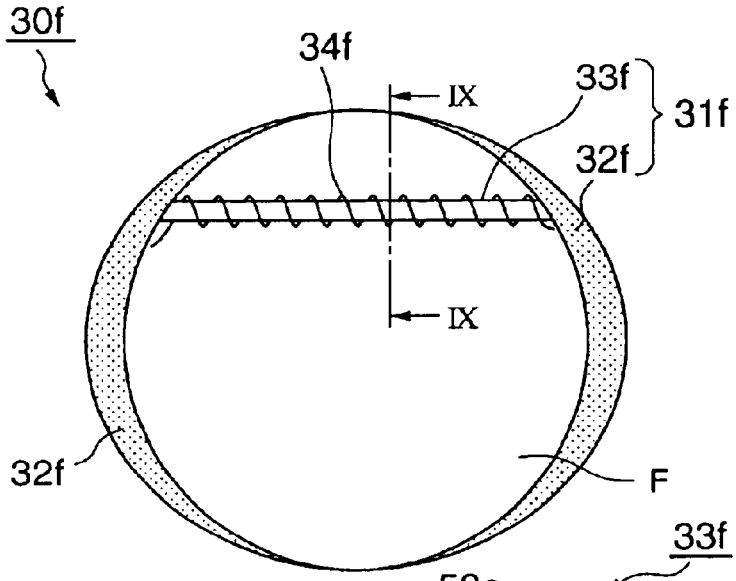
FIG. 8A is a schematic plan view of an antenna according to modification 5 of the first embodiment of the invention.
Figure 8B:
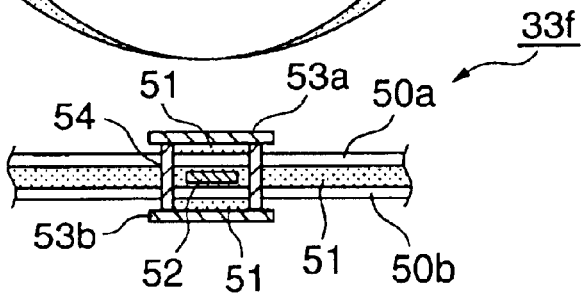
FIG. 8B is a cross-sectional view taken along the line IX—IX of FIG. 8A.

As shown in FIGS. 8A and 8B, an antenna 30*f* in accordance with modification 5 includes radio wave receiving parts 32*f* formed by copper foil or the like as a pattern at two positions on a film substrate F, and an antenna main body 33*f* comprising a film-type coil element disposed between the receiving parts 32*f*. The antenna main body 33*f* includes two sheets of base films 50*a* and 50*b* bonded each other with adhesive 51, each sheet made of synthetic resin such as polyethylene terephthalate (PET) or poly-vinyl chloride (PVC), and a film dielectric 52 embedded between the base films 50*a* and 50*b*. Over the surfaces of the base films 50*a* and 50*b*, there are provided thin film conductors 53*a* and 53*b* made of copper foil or the like adhered to the respective base films 50*a* and 50*b* with adhesive 51. These thin film conductors 53*a* and 53*b*, confronting each other and sandwiching the dielectric 52, are connected with conductive through holes 54. The thin film conductor 53 connected with the through holes 54 is spirally wound around the dielectric 52 to form a pseudo-coil having the dielectric 52 as a core substance.

With such a structure, the antenna 30*f* can be constructed much thinner than the antenna 30*e* having, as shown in FIG. 7A, the antenna main body 33*e* attached to the circuit board 13. Application of this thinner antenna 30*f* can make the wristwatch 100 much thinner.

[Second Embodiment]

Figure 9:
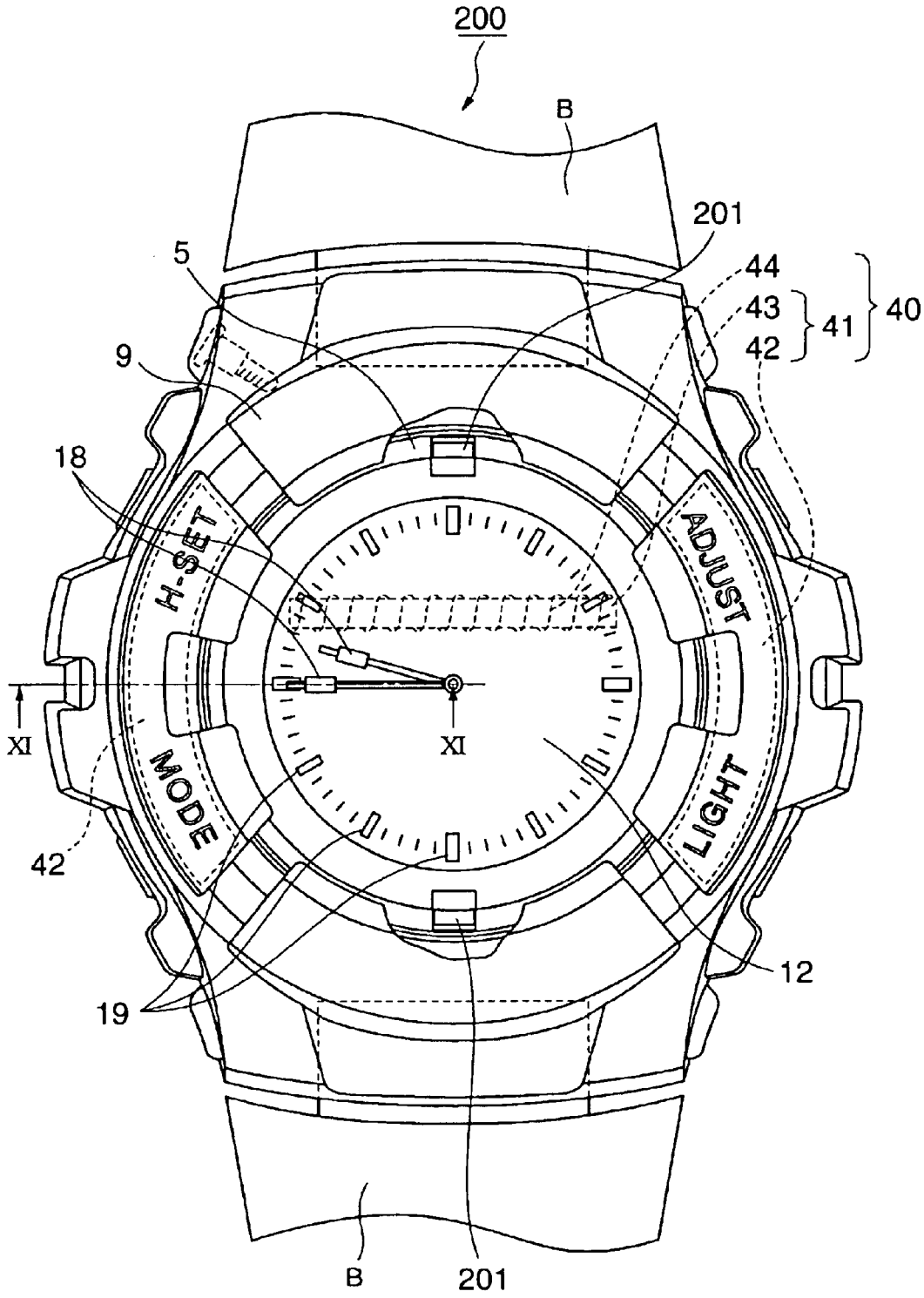
FIG. 9 is a schematic plan view of a wristwatch according to a second embodiment of the invention.
Figure 10:
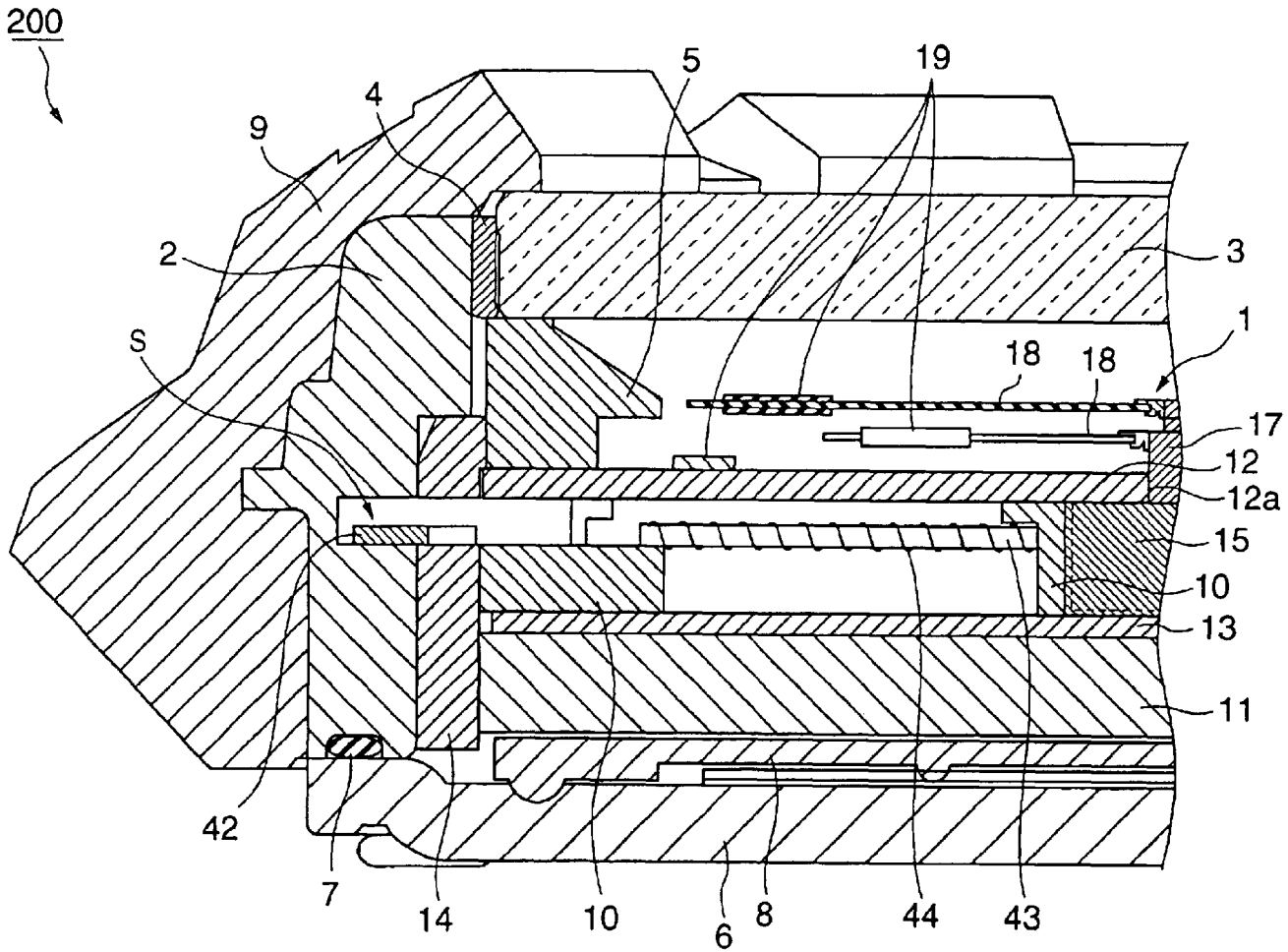
FIG. 10 is a cross-sectional view taken along the line XI—XI of FIG. 9.

Referring to FIGS. 9 and 10, an antenna 40 in accordance with a second embodiment is embedded within a wristwatch 200, and receives time information on radio waves to correct the indicated time of the wristwatch 200. Meanwhile, the same elements as those in the first embodiment are designated by the same reference numerals and the description thereof is omitted.

Figure 11A:
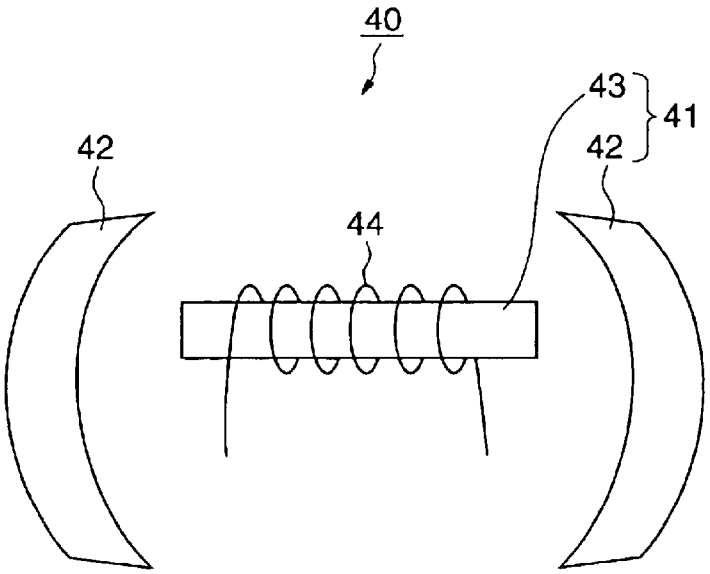
FIG. 11A is a schematic plan view of an antenna according to the second embodiment of the invention.
Figure 11B:
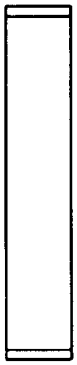
FIG. 11B is a schematic side view of a radio wave receiving part of an antenna according to the second embodiment of the invention.

The antenna 40, as shown in FIGS. 11A and 11B, has a magnetic body 41 magnetized by the radio waves, and a conductor 44 wound around the magnetic body 41, through which current flows depending on the intensity of magnetic field induced in the magnetic body 41.

The magnetic body 41 includes an antenna main body 43 having a conductor 44 wound around thereon, radio wave receiving parts 42 formed independently of the antenna main body 43 for receiving radio waves, and the like. The second embodiment differs from the first embodiment in that the radio wave receiving parts 42 are arranged apart from the antenna main body 43.

The radio wave receiving part 42 made of magnetic substance such as ferrite is, as shown in FIG. 10, disposed within a containing space S formed by the watch case 2 and the inner frame 14, being curved in a belt along the watch case 2 and the inner frame 14. The radio wave receiving parts 42 are arranged at opposing positions to each other such as, for example, the three o'clock and the nine o'clock positions, respectively, each part being spaced apart from the end of the antenna main body 43.

The antenna main body 43 made of magnetic substance such as ferrite is disposed between the opposing radio wave receiving parts 42, and supported on the upper housing 10 at its both ends.

The antenna main body 43 has a coil-like conductor 44 wound around thereon. With this structure, the radio wave caught by the radio wave receiving parts 42 magnetizes the antenna main body 43, which creates induction current on the conductor 44 according to the intensity of the magnetic field.

In the antenna 40 of the embodiment, the antenna main body 43 and the radio wave receiving parts 42 are formed independently, which permits the antenna body 43 and the radio wave receiving parts 42 to be formed in simple shapes, and therefore manufacturing of an entire magnetic body becomes easier even if the radio wave receiving parts 42 have large area of the radio wave receiving region of the radio wave receiving parts 42. Furthermore, without partially loaded position, the mechanical strength of the antenna 40 can be improved. Accordingly, compared with an earlier developed antenna, each radio wave receiving part 42 can have much larger area of the radio wave receiving region than the cross sectional area of the antenna main body 43 in the direction orthogonal to the axis line of the antenna main body 33 (the winding direction of the conductor 44 wound around the antenna main body 33). This larger receiving area allows improving the sensitivity of receiving radio waves, and also moderate directivity due to the increase of receivable directions.

Additionally, since the radio wave receiving parts 42 are arranged apart from the antenna main body 43, the layout flexibility of the antenna 40 can be improved. This flexibility allows the antenna to be favorably applied to small-sized electronic devices, such as the wristwatch 200, that require a limited occupying space.

<Modification 1>

Figure 12A:
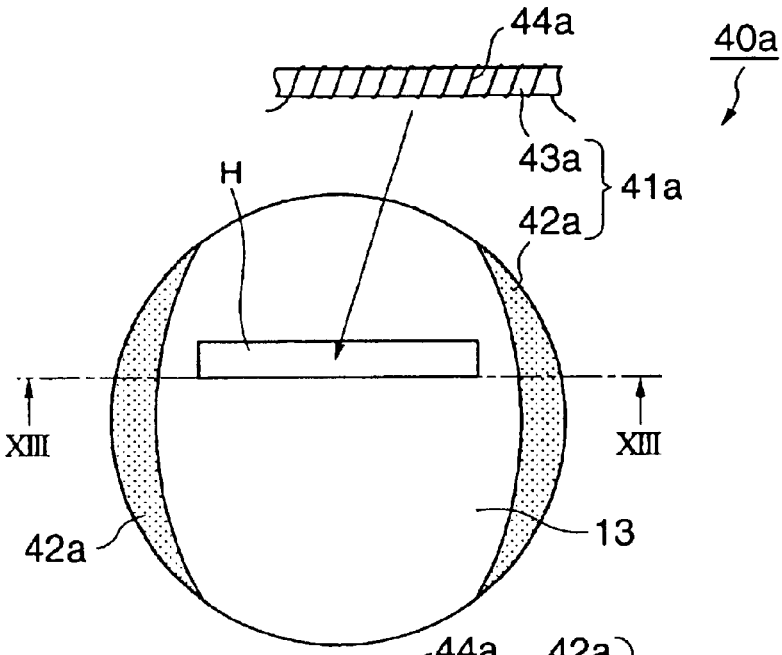
FIG. 12A is a schematic plan view of an antenna according to modification 1 of the second embodiment of the invention.
Figure 12B:
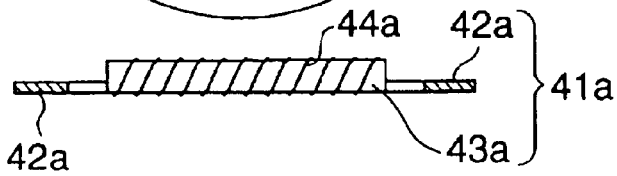
FIG. 12B is a cross-sectional view taken along the line XIII—XIII of FIG. 12A.
Figure 13:
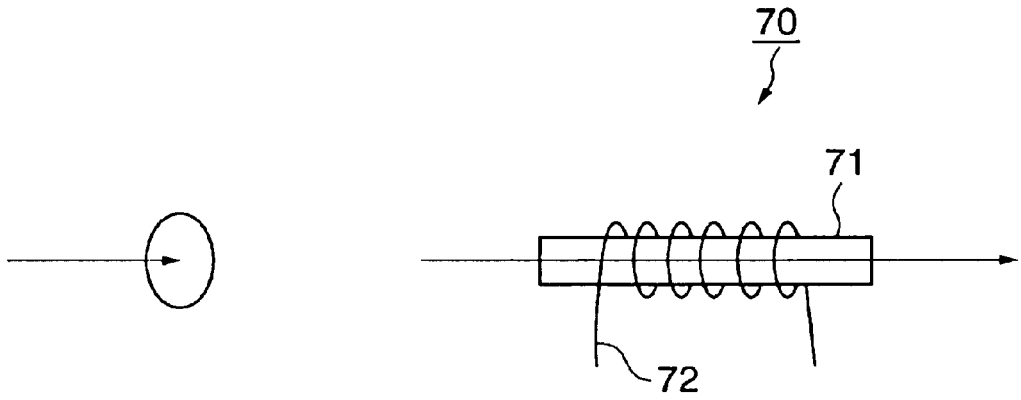
FIG.13 PRIOR ART
FIG. 13 illustrates an earlier developed antenna.
Figure 14:
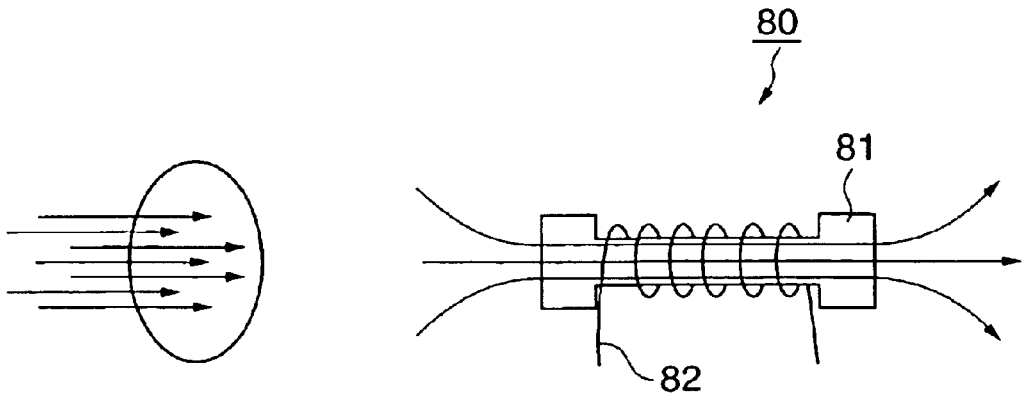
FIG.14 PRIOR ART
FIG. 14 illustrates another earlier developed antenna.

Referring to FIGS. 12A and 12B, in an antenna 40*a* according to modification 1, the arc-shaped radio wave receiving parts 42*a* of the second embodiment are formed on the circuit board 13 as a pattern, and the antenna main body 43 is removably attached to the circuit board 13.

Radio wave receiving parts 42*a* are formed as a pattern at two positions on the circuit board 13 with copper foil or the like, and a mounting hole H is formed between the receiving parts 42*a* for attaching an antenna main body 43*a*. The antenna main body 43*a* is fit into the mounting hole H to construct the antenna 40*a*.

Such a structure makes the thickness of the antenna 40*a* thinner than the antenna main body 43*a* by that of the circuit board 13. Application of this thinner antenna 40*a* can make the wristwatch 200 thinner.

The present invention is not limited to the embodiments described above. For instance, an antenna may be built in a digital wristwatch as well as an analog wristwatch. Various changes may also be made in the shape and arrangement of radio wave receiving parts and an antenna main body.

Other variations and modifications may be made without departing from the scope of the invention.

According to the present invention, the antenna main body and the radio wave receiving parts are formed independently, which permits the antenna body and the radio wave receiving parts to be formed in simple shapes, and therefore manufacturing of an entire magnetic body becomes easier even if the radio wave receiving parts have large areas of the radio wave receiving regions. Furthermore, without partially loaded position, the mechanical strength of the antenna can be improved. Accordingly, compared with an earlier developed antenna, each radio wave receiving part can have much larger area of the radio wave receiving region than the cross sectional area of the antenna main body in the direction orthogonal to the axis line of the antenna main body 33 (the winding direction of the conductor 34 wound around the antenna main body 33). This larger receiving area allows improving the sensitivity of receiving radio waves, and also moderate directivity due to the increase of receivable directions.

Since the radio wave receiving parts are arranged apart from the antenna main body, the layout flexibility of the antenna can be improved. This flexibility allows the antenna to be favorably applied to small-sized electronic devices, such as the wristwatch, that require a limited occupying space.

Since the radio wave receiving parts are formed on the circuit board as a pattern, which allows the radio wave receiving parts to be thin, thereby making the antenna thinner.

Since the radio wave receiving parts are arranged apart from the antenna main body, the layout flexibility of the antenna can be improved. This flexibility allows the antenna to be favorably applied to small-sized electronic devices, such as the wristwatch, that require a limited occupying space.

Further, by building in the antenna of the present invention, the wristwatch which has improved radio wave receiving sensitivity, and in which directivity can be moderated due to the increase of receivable directions can be provided.

What is claimed is:

1. An antenna comprising:

a magnetic body magnetized by a radio wave; and a conductor wound around a part of the magnetic body so as to flow a current according to an intensity of a magnetic field produced on the magnetic body, wherein the magnetic body comprises an antenna main body having the conductor wound around thereon and a radio wave receiving part which is formed independently of the antenna main body, for receiving a radio wave;

an area of a radio wave receiving region of the radio wave receiving part is larger than a cross sectional area of the antenna main body in a direction orthogonal to a winding direction of the conductor; and the radio wave receiving part is arranged so as to be in contact with the antenna main body at an end in the winding direction of the conductor.

2. The antenna as claimed in claim 1, wherein the radio wave receiving part comprises concavities for coupling the antenna main body thereto, the radio wave receiving part and the antenna main body being coupled by fitting ends of the antenna main body into the concavities of the radio wave receiving part.

3. The antenna as claimed in claim 1, wherein grooves are formed on the radio wave receiving part for coupling the antenna main body thereto, and protrusions which fit into the grooves of the radio wave receiving part are formed on ends of the antenna main body, the radio wave receiving part and the antenna main body being coupled by fitting the protrusions of the antenna main body into the grooves of the radio wave receiving part.

4. The antenna as claimed in claim 1, wherein both ends of the antenna main body are formed in a saw-toothed shape having continuous ridge and valley portions, and connection parts of the radio wave receiving part are formed in a saw-toothed shape having continuous ridge and valley portions, and the saw-toothed shapes of the antenna main body are engaged with the saw-toothed shapes of the radio wave receiving part.

5. The antenna as claimed in claim 1, wherein the radio wave receiving part is arranged apart from the antenna main body.

6. A wristwatch comprising the antenna as claimed in claim 1, which is contained in a case body of the wristwatch.

7. An antenna comprising:

a magnetic body magnetized by a radio wave; and a conductor wound around a part of the magnetic body so as to flow a current according to an intensity of a magnetic field produced on the magnetic body, wherein the magnetic body comprises an antenna main body having the conductor wound around thereon and a radio wave receiving part which is formed independently of the antenna main body, for receiving a radio wave;

an area of a radio wave receiving region of the radio wave receiving part is larger than a cross sectional area of the antenna main body in a direction orthogonal to a winding direction of the conductor; and the radio wave receiving part is formed on an electronic board as a pattern, and is arranged so as to be in contact with the antenna main body at an end in the winding direction of the conductor.

8. The antenna as claimed in claim 7, wherein the antenna is formed by fitting the antenna main body into a mounting hole formed in the electronic board.

9. The antenna as claimed in claim 7, wherein the radio wave receiving part is arranged apart from the antenna main body.

10. The antenna as claimed in claim 7, wherein the antenna main body comprises a film-type coil element on which the conductor is wound; and the radio wave receiving part is formed on a film substrate as a pattern, and is disposed on the film substrate so as to be in contact with the antenna main body at the end in an axis direction of the antenna main body.

11. A wristwatch comprising the antenna as claimed in claim 7, which is contained in a case body of the wristwatch.

* * * * *